US007874370B2

(12) United States Patent
Tjader

(10) Patent No.: US 7,874,370 B2
(45) **Date of Patent: *Jan. 25, 2011**

(54) DRILL STEM CONNECTION AND METHOD

(75) Inventor: Michael Tjader, New Richmond, WI (US)

(73) Assignee: TT Technologies, Inc., Aurora, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/612,416

(22) Filed: Nov. 4, 2009

(65) Prior Publication Data

US 2010/0044112 A1 Feb. 25, 2010

Related U.S. Application Data

(63) Continuation of application No. 11/925,353, filed on Oct. 26, 2007, now Pat. No. 7,628,212.

(60) Provisional application No. 60/863,073, filed on Oct. 26, 2006.

(51) Int. Cl.
*E21B 19/16* (2006.01)

(52) U.S. Cl. ..... 166/380; 166/77.51; 166/85.1

(58) Field of Classification Search ..... 175/85; 81/57.34; 166/377, 380, 379, 77.51, 85.1
See application file for complete search history.

(56) References Cited

U.S. PATENT DOCUMENTS 3,680,412 A * 8/1972 Mayer et al. ..... 81/57.34
4,143,721 A 3/1979 Zuvela et al.
5,062,326 A 11/1991 Goldschmidt
5,546,833 A 8/1996 Holdeman
5,775,183 A 7/1998 Tavianini
6,148,935 A 11/2000 Wentworth et al.
6,752,043 B2 6/2004 Carlson
6,931,965 B1 8/2005 Fanguy et al.
2003/0159854 A1 8/2003 Simpson et al.
2005/0103526 A1 5/2005 Ayling
2006/0099035 A1 5/2006 Wentworth (Continued)

FOREIGN PATENT DOCUMENTS

DE 102005003762 8/2006

(Continued)

OTHER PUBLICATIONS

"U.S. Appl. No. 11/925,353 , Notice of Allowance mailed Jul. 7, 2009", 8 pgs.

(Continued)

*Primary Examiner*—David J Bagnell
*Assistant Examiner*—Cathleen R Hutchins
(74) *Attorney, Agent, or Firm*—Schwegman Lundberg & Woessner, P.A.

(57) ABSTRACT

A drill stem connection system and method is shown that provides a secure hold on drill stem surfaces while unscrewing a threaded connection. Two lever arm components are adjustable to a number of possible orientations to allow for fitting the drill stem wrench in tight spaces. Concentric rotation of lever arm components facilitates connection of the lever arm components together. Configurations and methods shown provide a stable and powerful tool to loosen threaded drill stem effectively.

20 Claims, 8 Drawing Sheets

U.S. PATENT DOCUMENTS

2006/0131077 A1 6/2006 Tjader
2008/0128172 A1 6/2008 Tjader

FOREIGN PATENT DOCUMENTS

WO WO 2008051615 A1 5/2008

OTHER PUBLICATIONS

"U.S. Appl. No. 11/925,353, Final Office Action mailed Apr. 20, 2009", 12 pgs.
"U.S. Appl. No. 11/925,353, Non-Final Office Action Mailed on Nov. 5, 2008", 13 pgs.
"U.S. Appl. No. 11/925,353, Response filed Feb. 5, 2009 to Non-Final Office Action mailed Nov. 5, 2008", 21 pgs.
"U.S. Appl. No. 11/925,353, Response filed Jun. 22, 2009 to Final Office Action mailed Apr. 20, 2009", 10 pgs.
"U.S. Appl. No. 11/925,353, Response to Final Office Action mailed Apr. 20, 2009", 9 pgs.
"International Application Serial No. PCT/US2007/022755, International Search Report mailed Feb. 13, 2008", 6 pgs.
"International Application Serial No. PCT/US2007/022755, Written Opinion mailed Feb. 13, 2008", 5 pgs.

* cited by examiner

DRILL STEM CONNECTION AND METHOD

RELATED MATTERS

This patent application is a Continuation of U.S. application Ser. No. 11/925,353, filed on Oct. 26, 2007, which claims the benefit of priority, under 35 U.S.C. Section 119(e), to U.S. Provisional Patent Application Ser. No. 60/863,073, filed on Oct. 26, 2006, which applications are incorporated herein by reference in their entirety.

TECHNICAL FIELD

This invention relates to coupling and decoupling drill stem sections. Specifically, this invention relates to tools and methods for coupling and decoupling sonde housings or other drill stem components for use with horizontal directional drills.

BACKGROUND

Directional drilling is a useful technique for several procedures such as utility installation, etc. One common type of directional drilling is horizontal directional drilling (HDD), where a drill stem is extended essentially horizontally to form passages underground without the need for a trench. Drill heads in directional drilling typically have a feature which causes the drill head to steer in one direction when forced ahead by a drilling device. During a boring operation, pressure is applied through a drill stem from behind to the drill head. During a straight bore, the drill stem is typically rotated at a regular rate so that on average, only straight ahead drilling is accomplished. In order to steer a drill head, the rotation is temporarily stopped, and the drill head is allowed to steer in the desired direction. Once the steering maneuver is complete, the drill head is again rotated at a regular rate for straight ahead drilling.

In many HDD operations, an electronic transmitter called a sonde is coupled to a distal end of the drill stem. Signals transmitted from the sonde are detected by a receiver carried by an operator above ground. Various characteristics of the detected signal are then used to indicate a location and orientation of the distal end of the drill stem. This information can then be used to steer the drill stem in a desired direction.

When a bore is completed, typically the sonde and associated sonde housing are removed and a pipe, cable, transmission line is coupled to the drill stem to be pulled into the bore as the drill stem is pulled back. A common attachment between the sonde housing and the drill stem is a threaded connection such as a tapered thread as known in the industry. Currently large pipe wrenches are used to loosen the threaded connection, however use of large pipe wrenches within an exit pit of a horizontal bore presents a level of safety risk. Large torque forces can be necessary to loosen the threaded joint which can make breaking the connection difficult. What is needed is an improved wrench, connection system and method that makes connection and disconnection of drill stem joints easier, and improves safety.

DETAILED DESCRIPTION

Figure 1A:
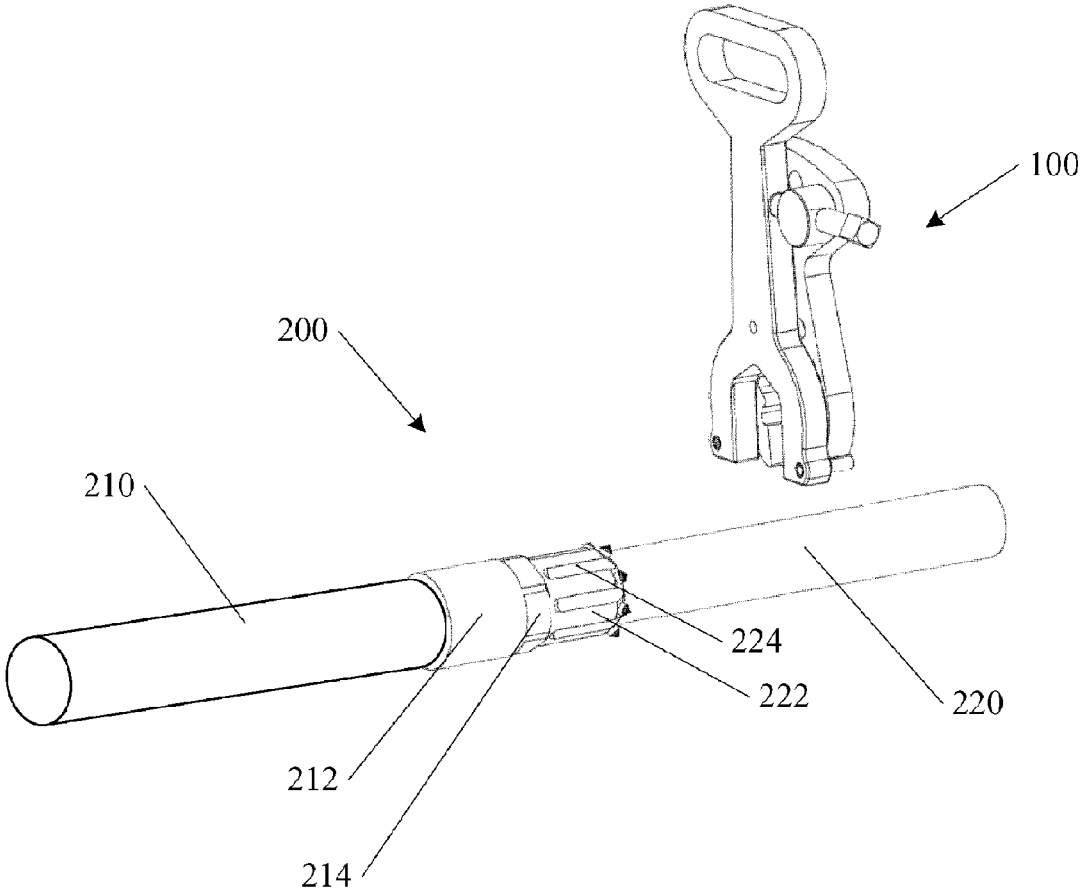
FIG. 1A shows a drill stem and wrench according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, mechanical or logical changes, material choice, etc. may be made without departing from the scope of the present invention. In the following description the term "breaking" unless otherwise noted refers to an operation of loosening a threaded connection where higher levels of starting friction forces are overcome, and lower sliding friction forces are then required to finish unscrewing a threaded connection. Unless otherwise noted, "breaking" does not refer to actually damaging any component.

FIG. 1A shows a wrench 100 and sections of drill stem 200 according to an embodiment of the invention. A first drill stem section 210 is shown coupled to a second drill stem section 220. In one embodiment, the first drill stem section 210 includes a sonde housing, and the second drill stem section 220 includes a starter shaft. Although a side loading sonde housing is within the scope of the invention, FIG. 1A illustrates an rear end loading sonde housing.

In one embodiment the first drill stem section 210 includes a coupling 212 with engagement features 214. In one embodiment, the coupling 212 is formed from a hard material such as tool steel. FIG. 1A illustrates a number of flats 214 as engagement features, although the invention is not so limited. Other engagement features include holes, splines, etc. Likewise in one embodiment the second drill stem section 220 includes a coupling 222 with engagement features 224. FIG. 1A illustrates a number of splines 224 as engagement features on the coupling 222. A wrench 100 is shown adjacent to the drill stem 200 that will be discussed in more detail below.

Figure 1B:
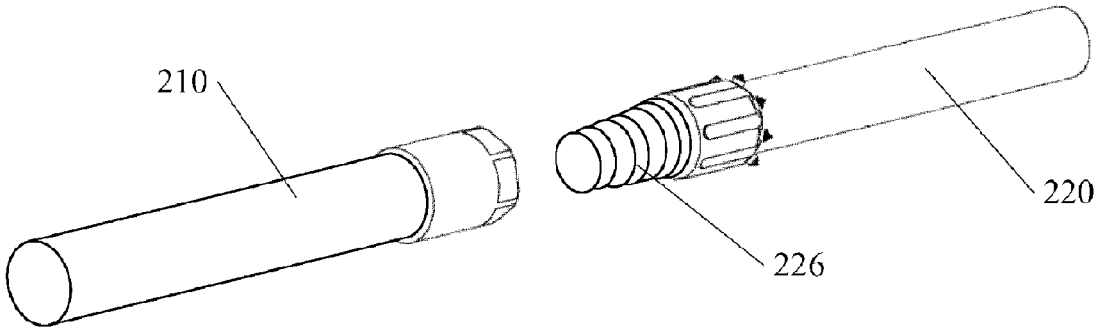
FIG. 1B shows drill stem components according to an embodiment of the invention.

FIG. 1B shows the first drill stem section 210 separated from the second drill stem section 220. In FIG. 1B, a threaded portion 226 is visible. In one embodiment, the threaded portion 226 includes a tapered thread as is common in the HDD industry. Although a male thread is shown on the second drill stem section 220 and a corresponding female thread is included on the first drill stem section, the invention is not so limited. One of ordinary skill in the art having the benefit of the present disclosure will recognize that the male and female threads could be reversed between the drill stem sections.

Figure 2:
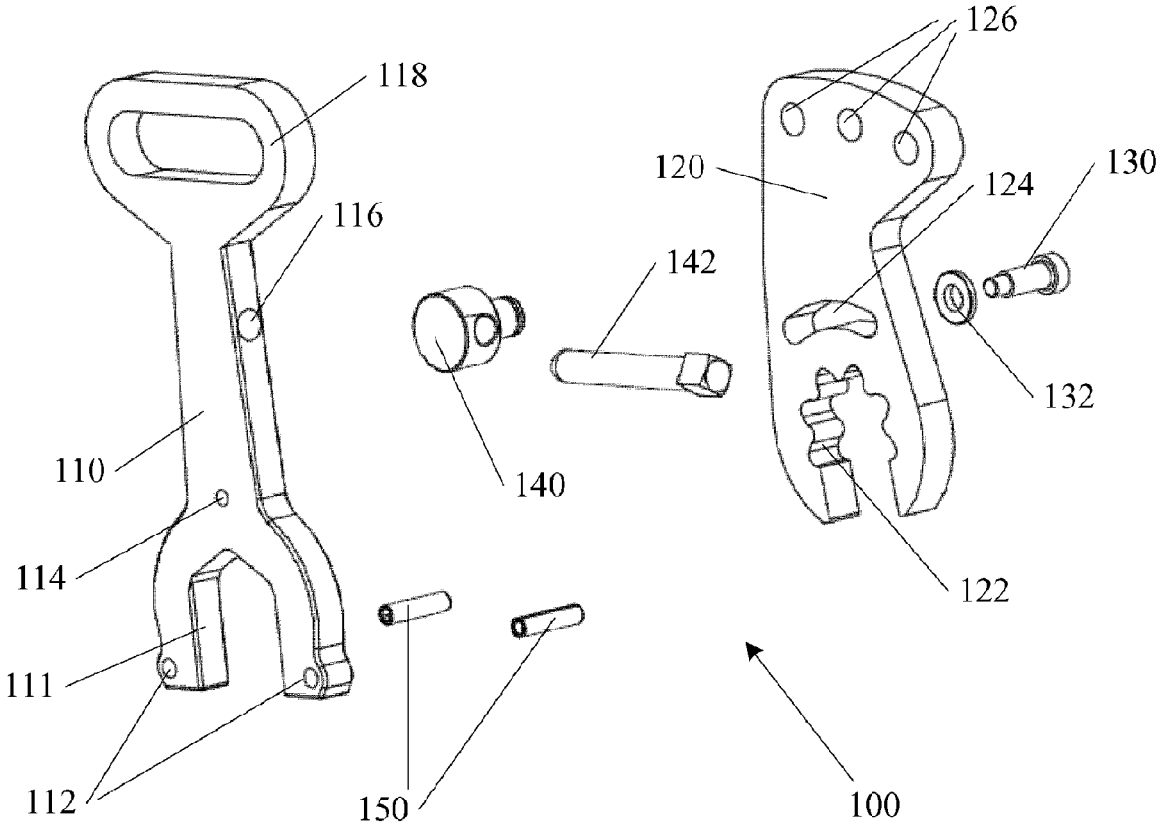
FIG. 2 shows an exploded view of a wrench according to an embodiment of the invention.

FIG. 2 illustrates an exploded view of one embodiment of wrench 100 as illustrated in FIG. 1A. The wrench 100 includes a first lever arm 110 and a second lever arm 120. A first wrench jaw 111 is included at a distal end of the first lever arm 110 and a second wrench jaw 122 is included at a distal end of the second lever arm 120. In one embodiment the first wrench jaw 111 includes at least a pair of parallel flat surfaces to engage at least two corresponding flats on a coupling. In one embodiment the second wrench jaw 122 includes one or more splines, likewise to correspond with a splined coupling. Although one wrench jaw is illustrated with flats and the other wrench jaw is illustrated with splines, the invention is not so limited. Other configurations include two jaws with flats, two jaws with splines, or other jaw configurations and combinations of jaw configurations.

One advantage of using a number of splines on one or more of the wrench jaws includes more available options for wrench orientations. When breaking a drill stem joint within a confined space such as an exit pit, frequently only a limited number of wrench orientations will fit into the space available. Having multiple splines spaced around a perimeter of a wrench jaw provides multiple orientations, with a higher likelihood that an available orientation will work within the limited space.

A slot 124 is shown in the second lever arm 120. In one embodiment a shoulder bolt 130 and washer 132 are used to couple the second lever arm 120 to the first lever arm 110 through the slot 124 into a mating threaded hole 114. In one embodiment, a pair of roll pins 150 line up adjacent to the second lever arm 120 and coordinate with the slot 124 and shoulder bolt 130 to form an axis of rotation between the first lever arm 110 and the second lever arm 120. In one embodiment, the axis of rotation is substantially within a center of both wrench jaws. Roll pins, in one embodiment, line up with rounded portions of the second lever arm 120 to guide relative rotation between the first lever arm 110 and the second lever arm 120.

Figure 3:
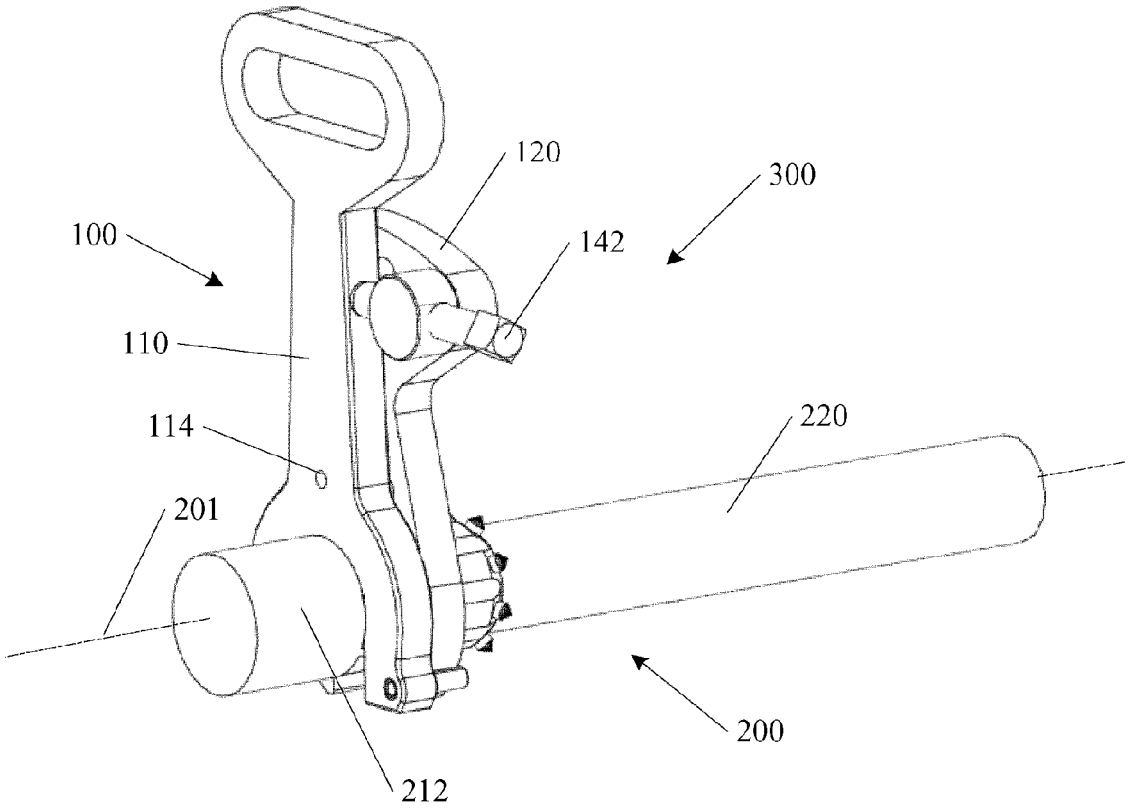
FIG. 3 shows an isometric view of a drill stem connection system according to an embodiment of the invention.

One advantage of such a configuration includes relative rotation between the first lever arm 110 and the second lever arm 120 that is concentric with the drill stem axis 201 as shown in FIG. 3 and discussed below. Another advantage of such a configuration with the first lever arm 110 and the second lever arm 120 coupled together includes increased stability during a connection/disconnection operation. A connection such as shoulder bolt 130 and washer 132 keeps the first lever arm 110 and the second lever arm 120 in alignment with each other to provide a safe and powerful joint breaking force.

An actuator 142 is also shown in FIG. 2. In one embodiment, the actuator 142 forces the first lever arm 110 apart from the second lever arm 120 to provide a joint breaking torque. In one embodiment, the actuator provides a mechanical advantage to amplify applied forces. The actuator 142 shown in FIG. 2 includes a threaded member such as a jack screw. Although a jack screw is shown, the invention is not so limited. Other actuators include various threaded members, cams, hydraulics, etc.

In one embodiment, a connector 140 with mating threads mounts to the second lever arm 120 while an end of the jack screw pushes against a pocket 116 in the first lever arm 110. In one embodiment the connector 140 is optionally located in one of a plurality of holes 126 in the second lever arm 120. The plurality of holes, along with starting location of the jack screw 142, provides a large range of adjustability in starting angle between the first lever arm 110 and the second lever arm 120. As discussed above, in conditions where working space is limited, it is desirable to have multiple options for starting angles.

FIG. 3 shows an connection system 300 with a wrench 100 in place on a drill stem 200. Only the coupling 212 of the sonde housing is shown attached to the starter shaft 220. In a disconnection operation, the actuator 142 jack screw is threaded down against the first lever arm 110. The first lever arm 110 is then rotated in relation to the second lever arm 120 to break the drill stem joint. In one embodiment, as discussed above, the axis of rotation between the first lever arm 110 and the second lever arm is substantially within the wrench jaws located on the respective lever arms. As shown in FIG. 3, in one embodiment the axis of rotation is substantially concentric with a drill stem axis 201. Concentric rotation as described in selected embodiments allows the first and second lever arms 110, 120 to be coupled together for stability, while applying torque on axis with the drill stem 200.

Figure 4:
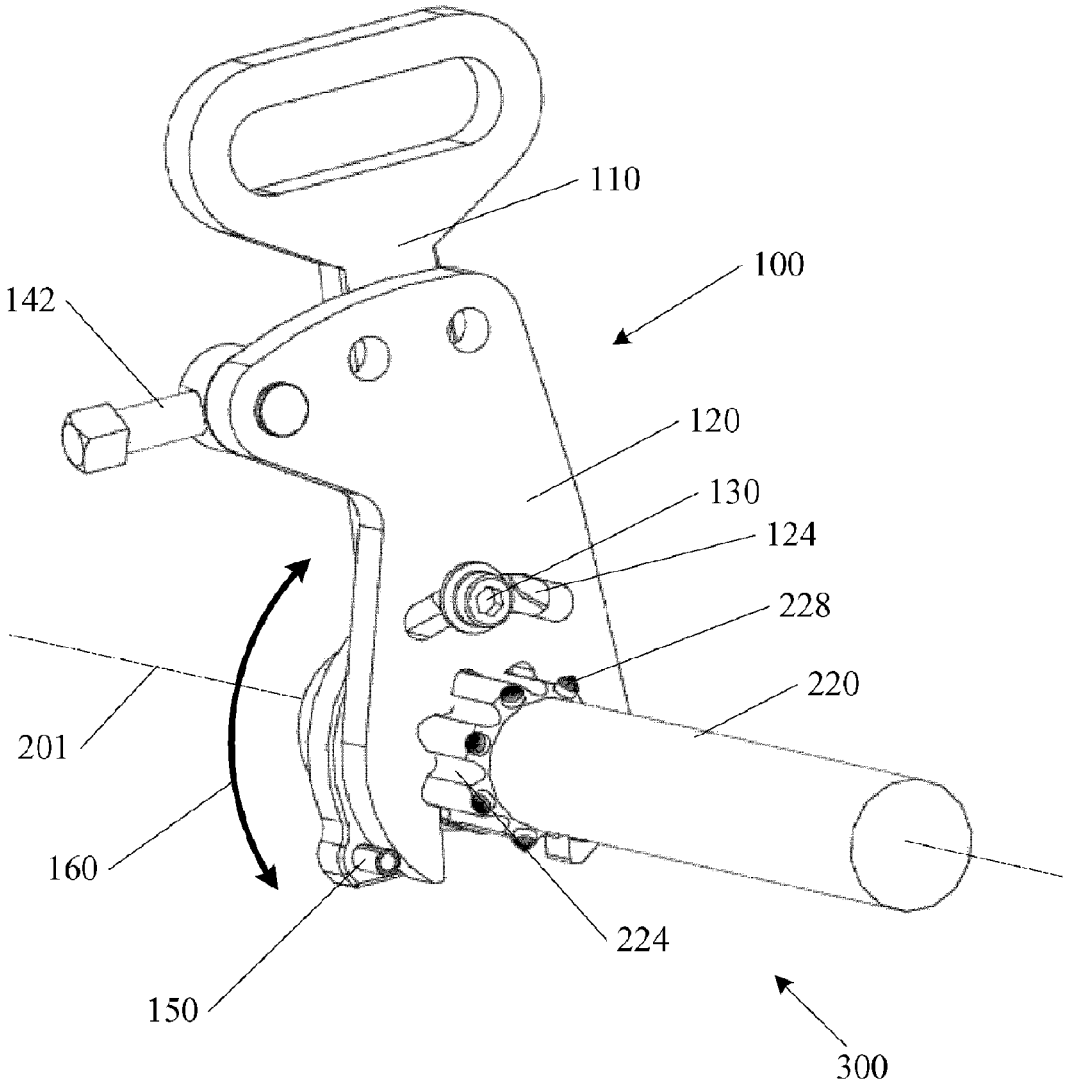
FIG. 4 shows another isometric view of a drill stem connection system according to an embodiment of the invention.

FIG. 4 shows another view of the system 300 shown in FIG. 3. The relative rotation of the first lever arm 110 with respect to the second lever arm 120 is illustrated by arrow 160. As can be seen in the Figure, the slot 124 and bolt 130 allow rotation, that is further guided by the roll pins 150.

In one embodiment, the starter shaft 220 further includes a number of inserts 228. As shown in FIG. 4, in one embodiment, the inserts are located on a back side of the splines 224. In one method of operation, the starter shaft 220 remains in place on the drill stem after the sonde housing 210 is removed. An advantage of including inserts such as tool steel or tungsten carbide inserts, includes better wear resistance of the splines 224 when withdrawing the drill stem 200 from the bore.

Figure 5:
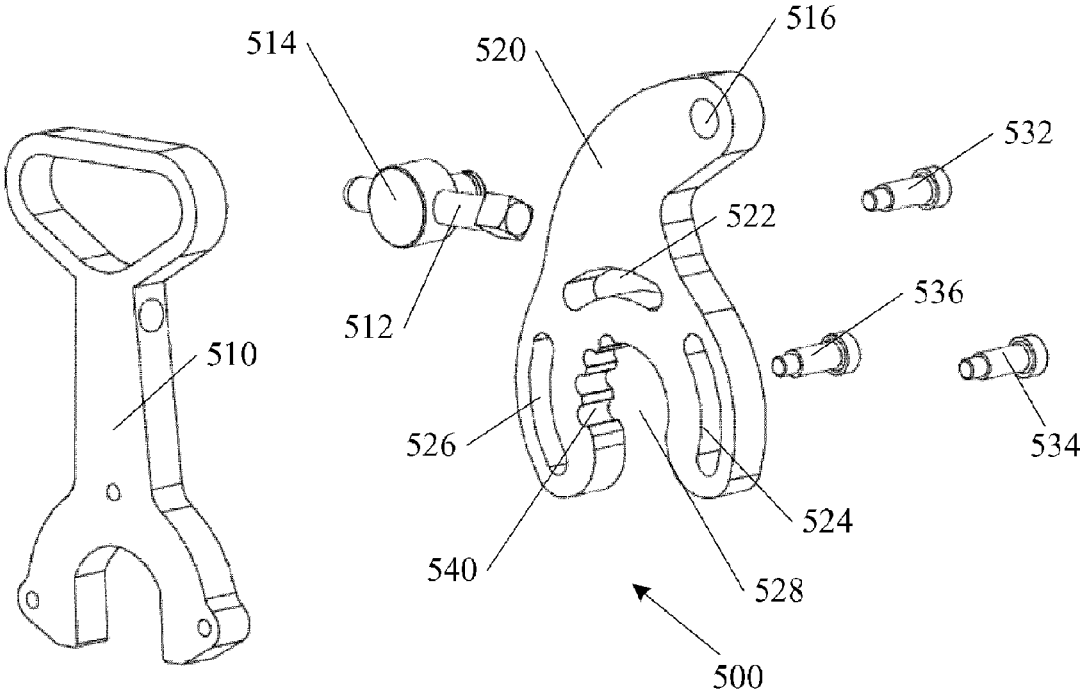
FIG. 5 shows another exploded view of a wrench according to an embodiment of the invention.

FIG. 5 shows an exploded view of another embodiment of a wrench 500. A first lever arm 510 and a second lever arm 520 are connected through shoulder bolts 532, 534 and 536. The shoulder bolts ride in respective slots 522, 524 and 526 within the second lever arm 520. Similar to embodiments described above, a jack screw actuator 512 is attached through a coupler 514 to the second lever arm 520 using hole 516.

The second lever arm 520 shown in FIG. 5 further includes a number of grooves 540 within a jaw opening 524. While four grooves 540 are shown, other embodiments include only one groove, or more than four grooves. Operation of the grooves 540 is described in more detail below.

Figure 6:
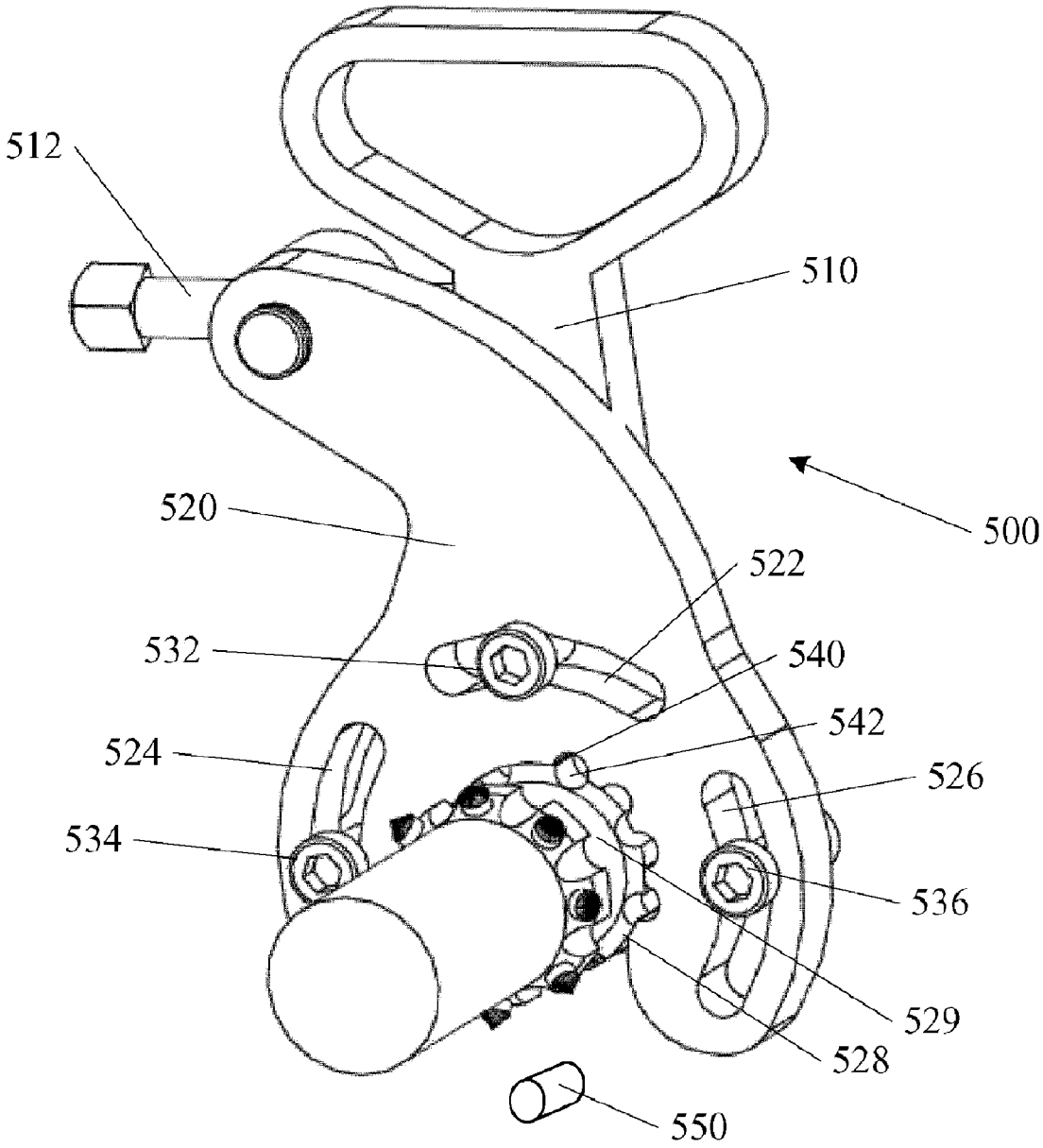
FIG. 6 shows an isometric view of a wrench as shown in FIG. 5 according to an embodiment of the invention.

FIG. 6 shows the wrench 500 coupled to a drill stem joint. Similar to embodiments described above, the first lever arm 510 is rotated with respect to the second lever arm 520 using the jack screw 512. The shoulder bolts 532, 534, and 536 are shown providing a connection between the first lever arm 510 and the second lever arm 520 with an axis of rotation that is within the wrench jaws, and substantially concentric with the drill stem axis.

Also shown in FIG. 6 are a number of splines with grooved spacings 542 on one of the drill stem components. The grooved spacings 542 are alignable with one or more of the grooves 540. Choosing which groove 540 and grooved spacing 542 to align provides multiple wrench orientation possibilities when starting a joint breaking or disconnecting operation. Once a grooved spacing 542 and a groove 540 are chosen, a key 550 is inserted into the aligned opening to transfer torque between the second lever arm 520 and the drill stem component. In one embodiment, the jaw opening 528 includes more than 180 degrees of material, such that the jaw opening 528 will pass over a slot 529 in the drill stem component, yet when engaged over the grooved spacings 542, the jaw opening 528 is held laterally captive on the drill stem component. This configuration helps keep the second lever arm 520 in place over the splines and keeps the key 550 more securely engaged with the grooved spacings 542 and the grooves 540.

Figure 7:
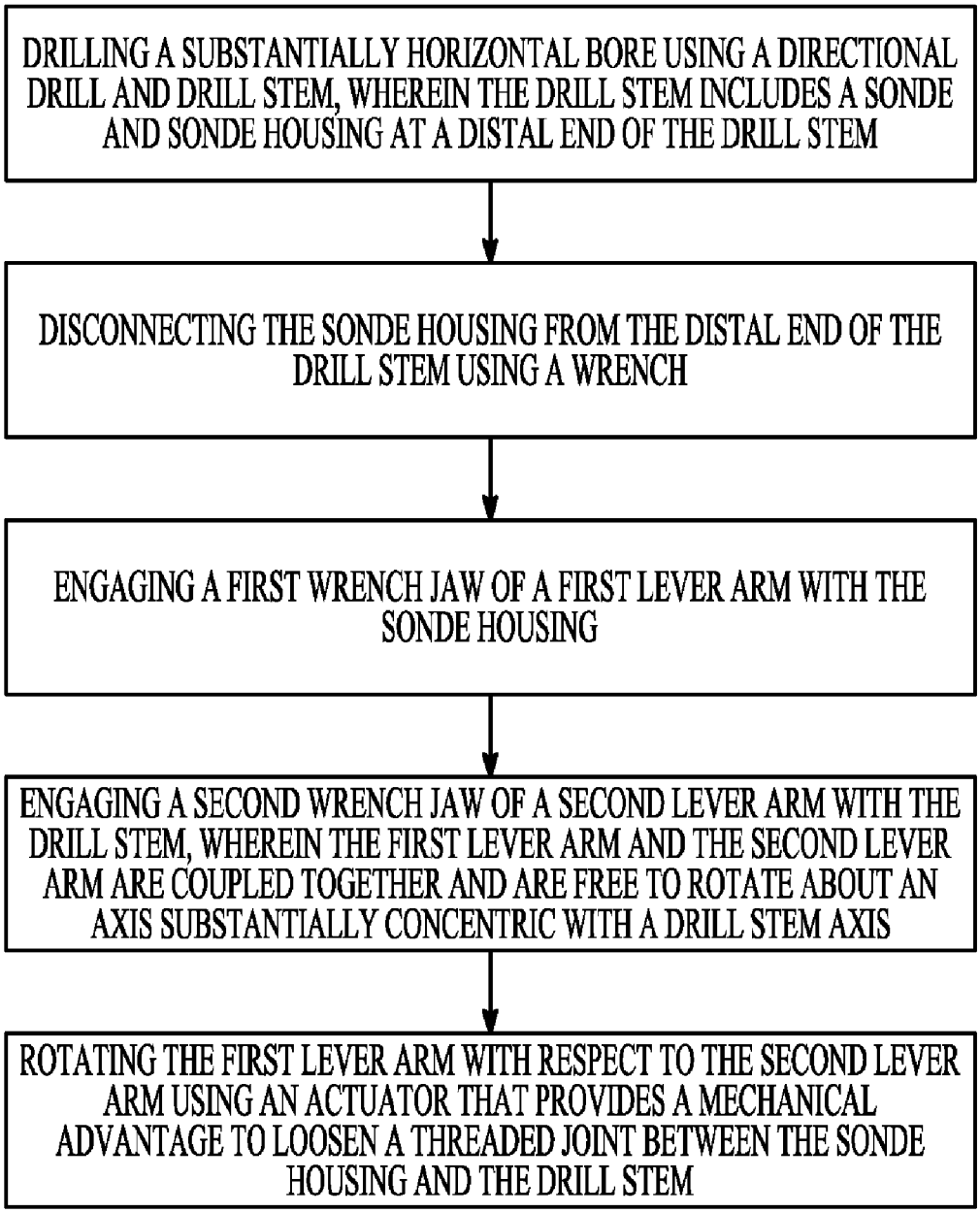
FIG. 7 shows one drilling method of operation according to an embodiment of the invention.
Figure 8:
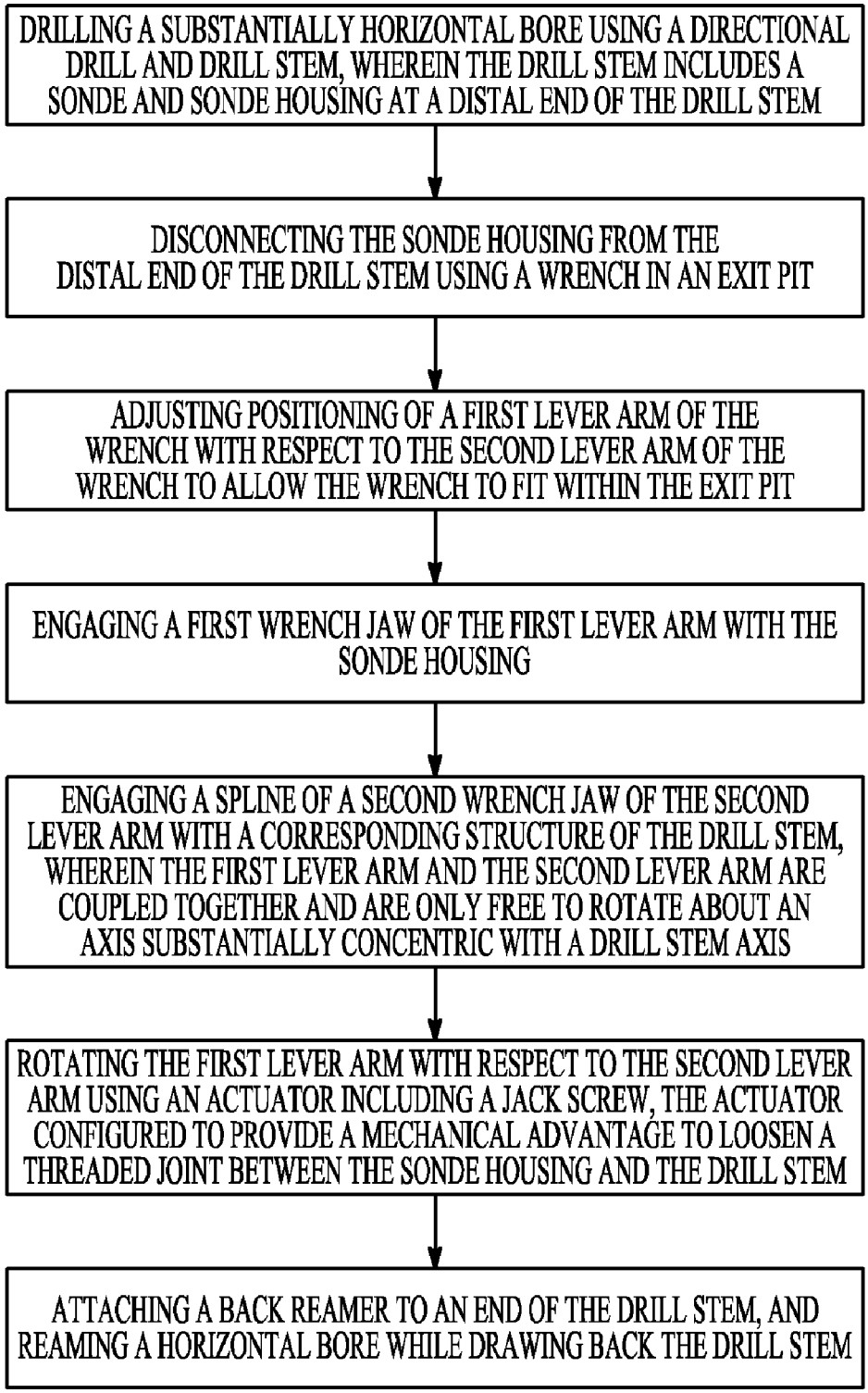
FIG. 8 shows another method of operation according to an embodiment of the invention.

FIG. 7 shows one possible method of use according to an embodiment of the invention. In a horizontal drilling operation one method includes drilling a substantially horizontal bore using a directional drill with a sonde housing at a distal end of the drill stem. The method further includes disconnecting the sonde housing from the distal end of the drill stem using a wrench as provided in embodiments described above. For example, engaging a first wrench jaw of a first lever arm with the sonde housing, and engaging a second wrench jaw of a second lever arm with the drill stem. The first lever arm and the second lever arm are coupled together and are free to rotate about an axis substantially concentric with a drill stem axis. In the method, one further rotates the first lever arm with respect to the second lever arm using an actuator that provides a mechanical advantage to loosen a threaded joint between the sonde housing and the drill stem. Although the method describes an operation including a sonde housing and a component such as a starter shaft, the invention is not so limited. Other drill stem components in a drill stem joint are included within the scope of the invention.

While a number of advantages of embodiments of the invention are described, the above lists are not intended to be exhaustive. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and methods are used. The scope of the invention should be determined with reference to the appended claims, along with the full scope of equivalents to which such claims are entitled.

The invention claimed is:

1. A drill stem system comprising:

a drill stem including a first drill stem section and a second drill stem section, the first and second drill stem sections including mating threads configured to selectively threadably engage the first and second drill stem sections, wherein the first drill stem section includes a first engagement feature and the second drill stem section includes a second engagement feature, the drill stem including a drill stem axis; and a drill stem wrench including:

a first arm including a first jaw, the first jaw including at least one spline configured to selectively engage the first engagement feature of the first drill stem;

a second arm including a second jaw, the first jaw rotatably coupled to the second jaw with the first and second arms rotatable about an axis of rotation disposed substantially through the first and second jaws of the drill stem wrench; and an actuator coupled to the first and second arms and configured to cause rotation of the first arm with respect to the second arm about the axis of rotation of the drill stem wrench with the drill stem disengaged from the first and second drill stem sections, wherein the axis of rotation of the drill stem wrench is substantially coincident with the drill stem axis with the drill stem wrench engaged with the drill stem, the actuator configured to provide a mechanical advantage to connect or disconnect the first and second drill stem sections.

2. The drill stem system of claim 1, wherein the first jaw extends at least partially around and defines a first jaw interior opening configured to accept the first engagement feature of the first drill stem section.

3. The drill stem system of claim 2, wherein the first jaw extends around the axis of rotation greater than one hundred eighty degrees to hold the drill stem wrench laterally captive on the first drill stem section when engaged with the first engagement feature.

4. The drill stem system of claim 3, wherein the first jaw includes a first gap therethrough configured to allow placement of the first jaw around the first drill stem section, the first gap including a width that is less than a width of the first engagement feature of the first drill stem, the width of the first gap being sufficient to accept a slot portion of the first drill stem therethrough, wherein the first jaw is configured to be placed around the first drill stem section at the slot portion and then slid into place with the first engagement feature disposed within the first jaw interior opening and in engagement with the at least one spline.

5. The drill stem system of claim 1, wherein the second jaw includes flats configured to selectively engage the second engagement feature of the second drill stem.

6. The drill stem system of claim 1, wherein the first and second jaws include fixed geometries.

7. The drill stem system of claim 1, wherein the actuator includes a jack screw.

8. The drill stem system of claim 1, wherein one of the first and second arms includes an arcuate slot and the other of the first and second arms includes a guide engaged thereto and extending through the arcuate slot to rotatably couple the first jaw and the second jaw.

9. The drill stem system of claim 1, wherein at least one of the first and second drill stem sections includes a wear insert disposed proximate at least one of the first engagement feature and the second engagement feature.

10. The drill stem system of claim 9, wherein the insert includes a tungsten carbide insert.

11. The drill stem system of claim 1, wherein at least one of the first and second arms includes two or more selectable actuator locations configured to selectively engage the actuator to adjust a starting angle between the first and second arms.

12. A drill stem system comprising:

a drill stem including a first drill stem section and a second drill stem section, the first and second drill stem sections including mating threads configured to selectively threadably engage the first and second drill stem sections, wherein the first drill stem section includes a first engagement feature including at least one spline and the second drill stem section includes a second engagement feature, the drill stem including a drill stem axis;

a drill stem wrench including:

a first arm including a first jaw configured to selectively engage the first engagement feature of the first drill stem;

a second arm including a second jaw, the first jaw rotatably coupled to the second jaw with the first and second arms rotatable about an axis of rotation disposed substantially through the first and second jaws of the drill stem wrench; and an actuator coupled to the first and second arms and configured to cause rotation of the first arm with respect to the second arm about the axis of rotation of the drill stem wrench with the drill stem disengaged from the first and second drill stem sections, wherein the axis of rotation of the drill stem wrench is substantially coincident with the drill stem axis with the drill stem wrench engaged with the drill stem, the actuator configured to provide a mechanical advantage to connect or disconnect the first and second drill stem sections; and a key, wherein at least one of the first and second drill stem sections includes a grooved spacing and at least one of the first and second arms of the drill stem wrench includes a groove, the groove being selectively alignable with the grooved spacing to form an aligned opening with the drill stem wrench engaged with the drill stem, the key selectively disposed within the aligned opening, the key being configured to transfer torque between the at least one of the first and second arms and the at least one of the first and second drill stem sections with the key disposed within the aligned opening.

13. The drill stem system of claim 12, wherein the first jaw extends at least partially around and defines a first jaw interior opening configured to accept the first engagement feature of the first drill stem section therein to engage the first engagement feature.

14. The drill stem system of claim 13, wherein the first jaw extends around the axis of rotation greater than one hundred eighty degrees to hold the drill stem wrench laterally captive on the first drill stem section with engagement of the first engagement feature.

15. The drill stem system of claim 14, wherein the first jaw includes a first gap therethrough configured to allow placement of the first jaw around the first drill stem section, the first gap including a width that is less than a width of the first engagement feature of the first drill stem, the width of the first gap being sufficient to accept a slot portion of the first drill stem therethrough, wherein the first jaw is configured to be placed around the first drill stem section at the slot portion and then slid into place with the first engagement feature disposed within the first jaw interior opening.

16. The drill stem system of claim 12, wherein the first and second jaws include fixed geometries.

17. A drill stem system comprising:

a drill stem including a first drill stem section and a second drill stem section, the first and second drill stem sections including mating threads configured to selectively threadably engage the first and second drill stem sections, wherein the first drill stem section includes a first engagement feature and the second drill stem section includes a second engagement feature, the drill stem including a drill stem axis; and a drill stem wrench including:

a first arm including a first jaw, the first jaw including at least one spline configured to selectively engage the first engagement feature of the first drill stem;

a second arm including a second jaw, the first jaw rotatably coupled to the second jaw with the first and second arms rotatable about an axis of rotation disposed substantially through the first and second jaws of the drill stem wrench;

a handle disposed at a proximal end of at least one of the first and second arms, the handle including a width at least as wide as a width of the first or second jaw to discourage use of a breaker bar with the at least one of the first and second arms; and an actuator coupled to the first and second arms and configured to cause rotation of the first arm with respect to the second arm about the axis of rotation of the drill stem wrench with the drill stem disengaged from the first and second drill stem sections, wherein the axis of rotation of the drill stem wrench is substantially coincident with the drill stem axis with the drill stem wrench engaged with the drill stem, the actuator configured to provide a mechanical advantage to connect or disconnect the first and second drill stem sections.

18. The drill stem system of claim 17, wherein the first jaw extends at least partially around and defines a first jaw interior opening configured to accept the first engagement feature of the first drill stem section therein to engage the first engagement feature with the at least one spline of the first jaw.

19. The drill stem system of claim 18, wherein the first jaw extends around the axis of rotation greater than one hundred eighty degrees to hold the drill stem wrench laterally captive on the first drill stem section when engaged with the first engagement feature.

20. The drill stem system of claim 19, wherein the first jaw includes a first gap therethrough configured to allow placement of the first jaw around the first drill stem section, the first gap including a width that is less than a width of the first engagement feature of the first drill stem, the width of the first gap being sufficient to accept a slot portion of the first drill stem therethrough, wherein the first jaw is configured to be placed around the first drill stem section at the slot portion and then slid into place with the first engagement feature disposed within the first jaw interior opening and in engagement with the at least one spline.

* * * * *